US008863716B2

(12) United States Patent
Dorn et al.

(10) Patent No.: US 8,863,716 B2
(45) Date of Patent: Oct. 21, 2014

(54) TAPPET

(75) Inventors: Stefan Dorn, Hollfeld (DE); Norbert Geyer, Hochstadt (DE); Karsten Kucht, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 9 days.

(21) Appl. No.: 13/808,202

(22) PCT Filed: May 16, 2011

(86) PCT No.: PCT/EP2011/057848

§ 371 (c)(1),
(2), (4) Date: Jan. 3, 2013

(87) PCT Pub. No.: WO2012/004037

PCT Pub. Date: Jan. 12, 2012

(65) Prior Publication Data

US 2013/0104818 A1 May 2, 2013

(30) Foreign Application Priority Data

Jul. 7, 2010 (DE) ..... 10 2010 026 360

(51) Int. Cl.

| | |
|---|---|
| ***F01L 1/14*** | (2006.01) |
| ***F04B 53/14*** | (2006.01) |
| ***F04B 1/04*** | (2006.01) |
| *F02M 59/10* | (2006.01) |
| *F02M 59/44* | (2006.01) |

(52) U.S. Cl.

CPC ..... *F01L 1/14* (2013.01); *F02M 59/102* (2013.01); *F01L 2105/00* (2013.01); *F04B 53/14* (2013.01); *F04B 1/0408* (2013.01); *F02M 59/44* (2013.01); *F01L 2107/00* (2013.01); *F01L 1/143* (2013.01)

USPC ..... 123/90.5

(58) Field of Classification Search

CPC combination set(s) only.
See application file for complete search history.

(56) References Cited

U.S. PATENT DOCUMENTS

| | | | | |
|---|---|---|---|---|
| 1,633,331 | A | 6/1927 | Jardine | |
| 6,474,279 | B2 * | 11/2002 | Faria | 123/90.16 |
| 7,793,583 | B2 * | 9/2010 | Radinger et al. | 92/129 |
| 2001/0009145 | A1 | 7/2001 | Faria et al. | |
| 2008/0190237 | A1 * | 8/2008 | Radinger et al. | 74/569 |

FOREIGN PATENT DOCUMENTS

| | | | |
|---|---|---|---|
| DE | 4323518 | | 2/1994 |
| DE | 4309602 | | 9/1994 |
| DE | 19600852 | | 7/1997 |
| DE | 10332980 | | 2/2005 |
| EP | 1669555 | A2 * | 6/2006 |
| JP | 2002332809 | | 11/2002 |
| WO | 2008068116 | | 6/2008 |
| WO | 2008095772 | | 8/2008 |

* cited by examiner

*Primary Examiner* — Thomas Denion
*Assistant Examiner* — Daniel Berstein
(74) *Attorney, Agent, or Firm* — Volpe and Koenig, P.C.

(57) ABSTRACT

The invention relates to a tappet (1) for a high-pressure fuel pump or for a valve drive of an internal combustion engine, comprising a housing (2) which has a cam run-on surface (4) on the drive side (3) thereof, wherein an output side (5) of the housing (2) rests on a lower face (6) of a bridge piece (8) that projects through an inner shell (7) of the housing (2), wherein an anti-turn lug (11) protrudes from the outer shell (10) of the housing (2) and is arranged in a window (9) in the latter, wherein said lug is substantially present as an upright body similar to a semi-cylinder in the region thereof protruding from the housing (2), and the outer surface (15) of said lug, in cross section, results in an ogival curve made up of two or more circular arcs (16).

7 Claims, 2 Drawing Sheets

TAPPET

BACKGROUND

The invention concerns a tappet, particularly for a high pressure fuel pump or for a valve train of an internal combustion engine, said tappet comprising a housing comprising on a drive side, a cam contacting surface, a driven side of said housing serving for an at least indirect contact of a pump piston or of a gas exchange valve being situated on an underside of a bridge member extending through an inner peripheral surface of said housing, an anti-rotation device extending in a window of said housing to project beyond an outer peripheral surface of said housing and said anti-rotation device serving for a non-forced engagement in an axial guide of a guide bore of a surrounding structure, said axial guide comprising a partially cylindrical cross-section and said guide bore receiving said housing.

In the tappets known from the prior art (s. WO 2008/095772, WO 2008/068116), which are exemplary for a roller tappet for an injection pump, the anti-rotation device comprises on its peripheral surface projecting beyond the housing, a circular cylindrical shape. During installation of the respective tappet in a guide bore of the injection pump or of a pump-associated component, the anti-rotation device engages with its partially cylindrical section in all cases into a complementary, partially cylindrical axial guide. This engagement is not designed for a "sucking" (non-forced guidance) but for providing a small lash with a desired small radial depth. Despite the relatively close tolerances that can only be met through complicated and expensive manufacturing procedures, it cannot be excluded that, in case of an unfavorable tolerance situation, a contact point of a peripheral surface of the anti-rotation device on the axial guide is situated near the guide bore or near an edge region of the axial guide to the guide bore. Thus, in case of a stop, undesired wear occurs and this wear is stronger if a surrounding structure is made of aluminum or the like.

SUMMARY

It is therefore an object of the invention to provide a tappet of the pre-cited type in which the aforesaid wear problems are eliminated by simple measures without the necessity of modifying the surrounding structure.

This object is achieved according to the invention by the fact that, in a region protruding beyond the housing, the anti-rotation device is configured substantially as an upright, semi-cylinder type body, whose peripheral surface creates a cross-section of an ogival arch formed by two or more circular arcs.

Due to the proposed profiling of the peripheral surface of the anti-rotation device in form of an ogival arch, wherein the axial guide is intended to retain its cylindrical shape so that no modifications are required on the pump or on the cylinder head, the aforesaid wear problems are eliminated.

A person skilled in the art will skillfully chose the radii of the, for instance, two circular arcs of the anti-rotation device that interact with a radius of the axial guide in such a way that the contact point, as seen from the contact zone in direction of the arcs, is definitely displaced toward the outside. Thus, it is perfectly obvious to choose, for example, a "depressed" or "normal" ogival arch shape, wherein a connecting line between the two center points of the radii can be situated radially further outside than the center point of the radius of the axial guide.

Advantageously, the contact point may be situated approximately in an angle of incidence of 45°. In addition, it is clear that each side of an arc of the peripheral surface of the anti-rotation device may also comprise, for instance, two or more radii (a multiple of two).

To guarantee a freedom of movement of the anti-rotation device in its axial guide under all tolerance conditions, the invention further proposes to "cut back" i.e. flatten a region of intersection of the two arcs of the anti-rotation device.

It is further advantageous to make the anti-rotation device such that it projects integrally from an edge of a separately made bridge member to then extend through the window of the housing. In this way, the manufacturing expenses for an assembly of an otherwise separately made anti-rotation device are avoided and the anti-rotation device cannot get lost during operation.

Alternatively, the anti-rotation device can be made as a separate body pressed, for example, into the window of the housing. It is also clear that the aforesaid bridge member, instead of being separately made, can also be connected integrally to the inner peripheral surface of the housing.

Similar to the housing, the bridge member can be made out of a light weight material such as sheet steel, while the housing can also be fabricated by extrusion, sintering or machining.

The tappet can be a roller tappet or a sliding tappet. In the first case, as mentioned in the specification of the invention, the tappet comprises on the housing side two, for example, receding flats situated diametrically opposite each other, in which flats a pin on which a roller for a direct run-on of a cam or an eccentric is seated through a rolling-bearing mounting or a slide mounting. For the second above-mentioned case, the tappet is closed in a section of its drive side front end by a bottom that serves for the cam or eccentric run-on.

A further dependent claim relates to the configuration of the contour of the anti-rotation device. It is indeed possible in the case of an integral connection to the separate bridge member to produce said contour during the punching-out of the bridge member. It is, however, also within the concept of the invention to provide a higher contour than that of the bridge member, for example, through upsetting, stamping, drawing and ironing, or bending. If necessary, it is also possible to apply a further separate body on the separately manufactured bridge member for forming the anti-rotation device.

The scope of the present invention also applies to a solution comprising a tappet whose axial guide is arranged in the surrounding structure.

BRIEF DESCRIPTION OF THE DRAWINGS

Referring now to the drawing.

DETAILED DESCRIPTION OF THE PREFERRED EMBODIMENTS

Figure 1:
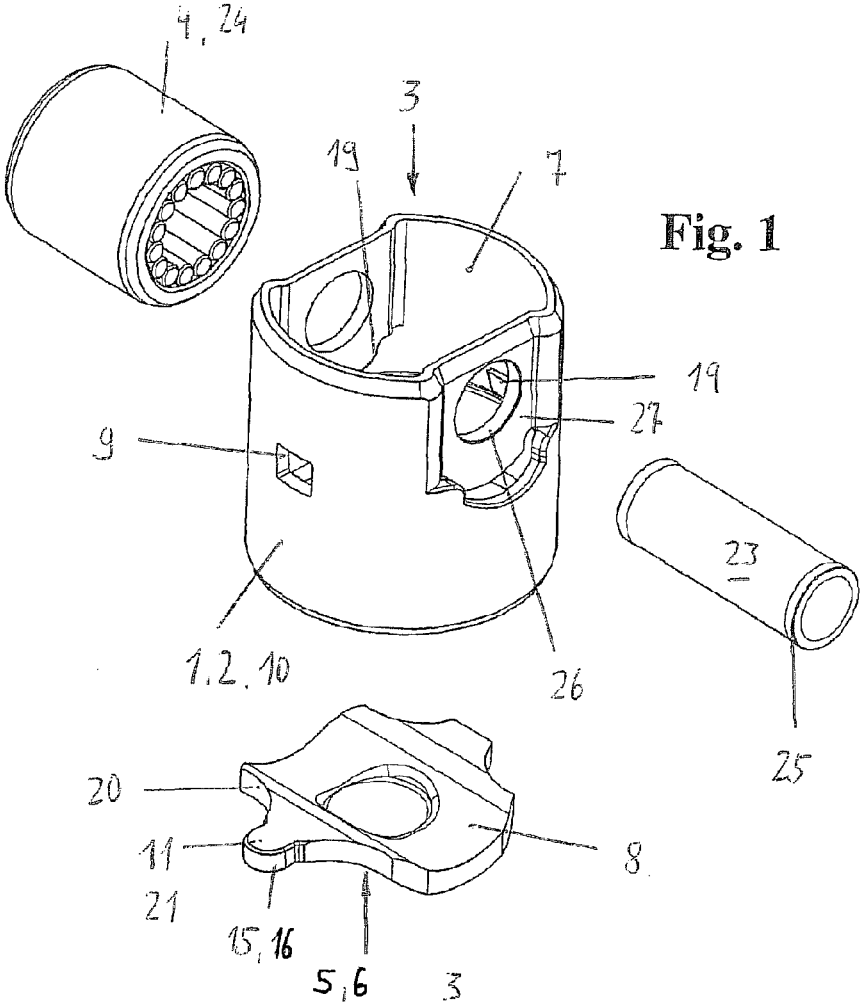
FIG. 1 shows a tappet configured as a roller tappet and comprising an anti-rotation device, in an exploded view.
Figure 2:
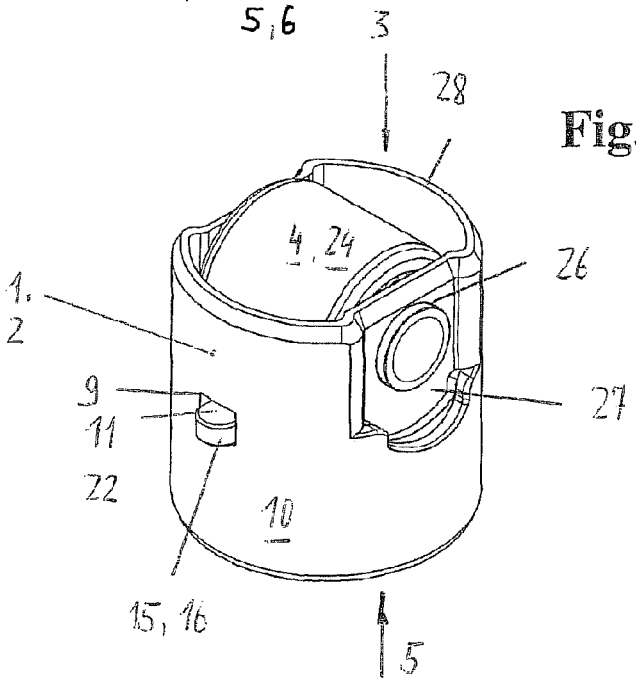
FIG. 2 shows the tappet of FIG. 1 in a three-dimensional view.

The basic structure of the tappet 1 can be seen in FIGS. 1, 2. As illustrated, this tappet serves for a loading of a pump piston of a high pressure fuel pump of an internal combustion engine with a quality or quantity based control system. The tappet can, however, also be used for an at least indirect loading of at least one gas exchange valve of a valve train of an internal combustion engine.

The tappet 1 comprises a housing 2 comprising on its drive side 3 a cam contacting surface 4. The cam contacting surface 4 is constituted by a roller 24 extending on a pin 23, each of two ends 25 of the roller 24 extends in a respective mounting eye 26 of a radially receding flat 27 of the housing 2. The flats 27 start from a drive side annular front end 28 of the housing 2.

A driven side 5 of the housing 2 serving as a support for aforesaid the pump piston is situated on an underside 6 of a bridge member 8 that extends through an inner peripheral surface 7 of the housing 2. The bridge member 8 is configured as a separate, thin-walled piece out of sheet steel and is retained on projections 19 extending inwards from the inner peripheral surface 7 of the housing 2. It can be seen that a fixation in drive direction is realized on transverse sides of the flats 27 identified at "19" in FIG. 1. Retention in driven direction is realized through peripherally offset snap lugs, or through at least one snap lug, likewise identified at "19", protruding inwards from the inner peripheral surface 7 of the housing 2.

An anti-rotation device 11 extends in a window 9 of the housing 2 and protrudes beyond an outer peripheral surface 10 of the housing 2. The anti-rotation device 11 is formed out of a finger-like radial extension 21 that projects from the edge 20 of the bridge member 8 and protrudes out of the window 9.

Figure 3:
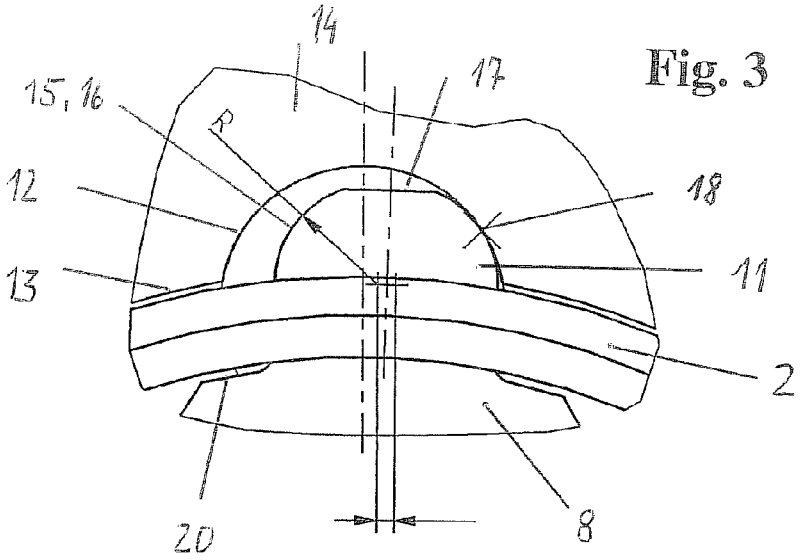
FIG. 3 shows a detail view in transverse direction in the region of the anti-rotation device.
Figure 4:
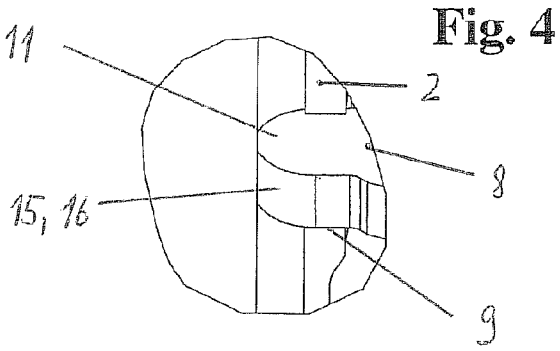
Fig. 4 Prior Art
FIG. 4 shows a three dimensional detail view of the anti-rotation device engaged in its axial guide.

As can best be seen in FIGS. 3, 4, the anti-rotation device 11 is configured in its region protruding beyond the housing 2, substantially in form of an upright, semi-cylindrical body whose peripheral surface 15 forms, in cross-section, an ogival arch formed by two circular arcs 16 (gothic profile). It can be seen that the anti-rotation device 1 does not osculate completely through its peripheral surface 15 (is not force-guided) in the axial guide 12, which is common practice.

Due to the fact that the peripheral surface 15 is made up of two circular arcs 16, it is possible, without modification of the axial guide 12, to displace a contact point 18 reliably away from an edge region of the axial guide 12 near the guide bore 13, radially outwards, as seen in direction of the arcs.

The anti-rotation device 11 can also be made, as disclosed schematically in FIG. 2, as a separate component 22. However, according to the illustration in FIG. 2, it is equally feasible to make the anti-rotation device 11 as a radial extension 21 of the separately configured bridge member 8 made, for instance, by punching out of sheet metal, as mentioned above.

From FIG. 3 it can be seen that a radially outer region 17 of the anti-rotation device 11 (region of intersection of the at least two circular arcs 16 has a flattened configuration.

Figure 5:
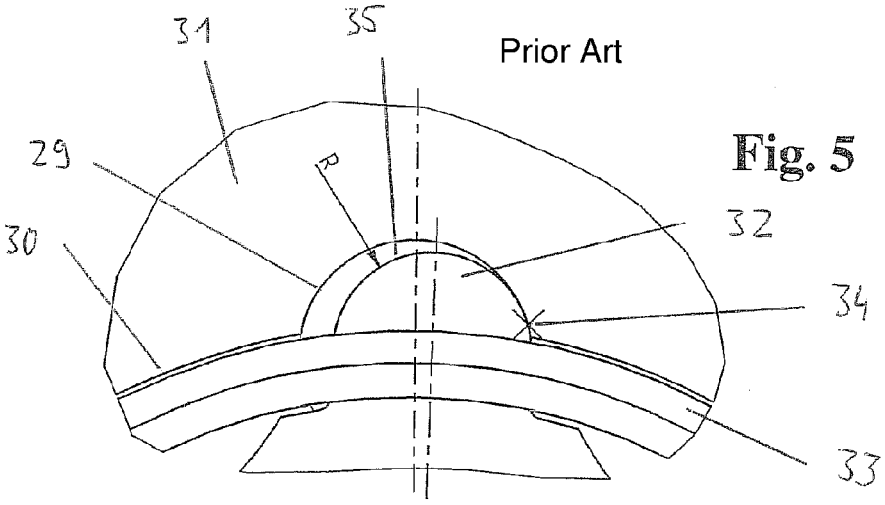
FIG. 5 shows a detail view in transverse direction in the region an anti-rotation device according to the prior art.

FIG. 5 shows a design of an anti-rotation device 32 of the prior art in a partial view corresponding to that of FIG. 3. It can be seen that a peripheral surface 35 of the anti-rotation device 32 comprises only one radius. In case of an unfavorable tolerance situation, furthered by a desired small radial "installation depth" of the anti-rotation device 32 in its axial guide 29, a contact point 34 of the abutting anti-rotation device 32 on the axial guide 29 is situated directly against an edge of the guide bore 29. As a result, undesired wear, which is eliminated through the inventive measures, occurs in this region.

LIST OF REFERENCE NUMERALS

1 Tappet
2 Housing
3 Drive side
4 Cam contacting surface
5 Driven side
6 Underside
7 Inner peripheral surface
8 Bridge member
9 Window
10 Outer peripheral surface
11 Anti-rotation device
12 Axial guide
13 Guide bore
14 Surrounding structure
15 Peripheral surface
16 Circular arc
17 Outer region
18 Contact point
19 Projection
20 Edge
21 Radial extension
22 Component
23 Pin
24 Roller
25 End
26 Mounting eye
27 Flat
28 Annular front end
29 Axial guide (prior art)
30 Guide bore (prior art)
31 Surrounding structure (prior art)
32 Anti-rotation device (prior art)
33 Housing (prior art)
34 Contact point (prior art)
35 Peripheral surface (prior art)

The invention claimed is:

1. A tappet, comprising a housing comprising on a drive side, a cam contacting surface, a driven side of said housing serving for an at least indirect contact of a pump piston or of a gas exchange valve being situated on an underside of a bridge member extending across an inner peripheral surface of said housing, an anti-rotation device extending from a window of said housing to project beyond an outer peripheral surface of said housing and said anti-rotation device serving for a non-forced engagement in an axial guide of a guide bore of a surrounding structure, said axial guide comprising a partially cylindrical cross-section and said guide bore receiving said housing, in a region protruding beyond the housing, the anti-rotation device is configured substantially as an upright, semi-cylinder type body, having a peripheral surface that possesses a cross-section of an ogival arch formed out of two circular arcs connected by a straight line in a radially outer region.

2. A tappet according to claim 1, wherein the bridge member is a separate, thin-walled component that is retained at least in a direction toward the drive side on projections projecting inwards from the inner peripheral surface of the housing.

3. A tappet according to claim 2, wherein the anti-rotation device is formed by a radial extension projecting as a finger from an edge of the bridge member and through the window.

4. A tappet according to claim 3, wherein the radial extension connected integrally to the bridge member is formed to a final contour substantially either a) through a non-machining method or b) directly during punching of the bridge member made out of sheet steel or c) by machining.

5. A tappet according to claim 1, wherein the anti-rotation device is a separate component that is fixed in the window.

6. A tappet according to claim 1, wherein a roller extending on a pin forms the cam contacting surface, each of two ends of the roller extends in a mounting eye of a radially receding flat of the housing, and said flats start from a drive side annular front end of the housing or are situated at least in a vicinity of said front end.

7. A tappet according to claim 1, wherein the housing is deep drawn sheet steel or extruded steel.

* * * * *